United States Patent [19]

Osakabe et al.

[11] 4,376,272

[45] Mar. 8, 1983

[54] MAGNETIC FIELD GENERATORS FOR USE IN ELECTROMAGNETIC FOCUSING TYPE CATHODE RAY TUBES

[75] Inventors: Kuniharu Osakabe; Isao Yoshimi, both of Mobara; Soichi Sakurai, Yokohama, all of Japan

[73] Assignee: Hitachi, Ltd., Tokyo, Japan

[21] Appl. No.: 319,797

[22] Filed: Nov. 9, 1981

[30] Foreign Application Priority Data

Nov. 12, 1980 [JP] Japan ..... 55-158284

[51] Int. Cl.[3] ..... H01F 3/12

[52] U.S. Cl. ..... 335/211; 335/217

[58] Field of Search ..... 335/211, 217, 210, 208

[56] References Cited

U.S. PATENT DOCUMENTS 3,623,151 11/1971 Ikeuchi ..... 335/217 X
3,831,051 8/1974 Ohgoshi et al. ..... 335/217 X
3,873,877 3/1975 Machida et al. ..... 335/217 X
4,023,128 5/1977 Itou et al. ..... 335/217 X

FOREIGN PATENT DOCUMENTS 54-55164 2/1979 Japan ..... 335/211

*Primary Examiner*—George Harris
*Attorney, Agent, or Firm*—Charles E. Pfund

[57] ABSTRACT

In a magnetic field generator mounted about a neck of a cathode ray tube for focusing an electron beam and made up of a permanent magnet, a magnetic field adjusting mechanism for adjusting field intensity produced by the permanent magnet and a magnetic member adapted to compensate for a temperature characteristic of the permanent magnet, the temperature characteristic compensating member is located at a position not affected by magnetic flux adjusted by the magnetic field adjusting mechanism.

6 Claims, 7 Drawing Figures

MAGNETIC FIELD GENERATORS FOR USE IN ELECTROMAGNETIC FOCUSING TYPE CATHODE RAY TUBES

BACKGROUND OF THE INVENTION

This invention relates to a magnetic field generator for use in an electromagnetic focusing type cathode ray tube, more particularly of the type utilizing a permanent magnet positioned on the outside of the tube to act as a flux generator for focusing an electron beam. More particularly, the invention relates to a device for compensating for the deterioration of the field intensity generated by the permanent magnet due to temperature rise.

Generally, an electromagnetic focusing type lens is more advantageous than an electrostatic lens in that its spherical and chromatic aberrations are small and its deterioration caused by space charge or the like is also small, so that it has an excellent resolving power.

A permanent magnet or an electromagnetic coil is used as a magnetic field generator for use in an electromagnetic focusing type cathode ray tube, but an excellent magnetic field generator can be formed by combining a low cost ferrite magnet and a magnetic member whose permeability varies greatly in accordance with temperature, as disclosed in Japanese Preliminary Publication of Patent No. Sho 54-55164.

FIG. 1 is a sectional view showing a basic construction of an electromagnetic focusing type cathode ray tube utilizing a permanent magnet acting as a focusing device of an electron beam, in which 1 represents a cathode ray tube, 2 a permanent magnet for generating magnetic flux and 3 lines of magnetic force generated by the permanent magnet 2. In this case, the permanent magnet 2 takes the form of a cylinder magnetized in the direction of the axis of the cathode ray tube 1 and mounted to surround a neck 1*a* containing an electron gun structure, not shown. The lines of magnetic force 3 are substantially parallel with the tube axis in the neck 1*a* for focusing an electron beam emitted by an electron gun structure. When the potential distribution in the neck 1*a* is determined, an optimum field intensity can be determined at once and when the field intensity is stronger or weaker than the optimum value, the size of an electron beam spot increases, thus degrading the resolution of a picture image.

FIG. 2 is an enlarged sectional view of a permanent magnet structure for producing magnetic field for focusing an electron beam which comprises an annular permanent magnet corresponding to the permanent magnet 2 shown in FIG. 1, first and second annular yoke plates 5*a* and 5*b* made of soft ferromagnetic material such as soft iron and secured to the opposite end surfaces of the annular permanent magnet 4 for rectifying the flux generated by the permanent magnet 4, a flux rectifying cylinder 6 closely surrounding the periphery of the permanent magnet 4 and made of a magnetic material, for example a Ni - Fe alloy, which varies its permeability according to temperature and is utilized to compensate for the temperature characteristic of the permanent magnet 4, and an adjustable cylindrical piece 7 made of such soft ferromagnetic material as soft iron and threaded onto the periphery of the first yoke plate 5*a* for finely adjusting the flux or field intensity between the first and second yoke plates 5*a* and 5*b*, the cylindrical piece 7 and the first yoke plate 5*a* constituting a field adjusting mechanism 8.

In the electron beam focusing magnet structure shown in FIG. 2, when the cylindrical adjusting piece 7 threaded on the periphery of the first yoke plate 5*a* is moved toward the second yoke plate 5*b* (in the direction of arrow B) the reluctance between the adjusting piece 7 and the second yoke plate 5*b* decreases so that the flux passing therebetween increases. Consequently, the flux along the tube axis decreases to weaken the intensity of the magnetic field acting upon the electron beam. On the other hand, when the adjusting piece 7 is moved toward the first yoke plate 5*a* (in the direction of A) reverse effect occurs. Thus, by moving the adjusting piece, it is possible to adjust the field intensity that focuses the electron beam.

With the magnetic field generator described above, however, as the temperature of the neck of the cathode ray tube rises to about 100° C. from room temperature temperature of the entire magnet structure also increases. Accordingly, where a low cost ferrite magnet, for example barium ferrite or strontium ferrite magnet is used, the flux generated decreases at a rate of 0.2% per degree centigrade. As the temperature rises, the permeability of the flux rectifying cylinder 6 closely disposed about the periphery of the permanent magnet 4 decreases greatly so that the reluctance of the cylinder 6 increases to decrease the magnetic flux flowing therethrough. This compensates for the decrease in the flux along the tube axis, thus compensating for the temperature characteristic of the permanent magnet. The temperature characteristic compensation effect varies depending upon the material characteristic and the configuration of the flux rectifying cylinder 6.

With the magnetic flux generator described above, however, when the position of the adjusting piece 7 is varied for adjusting the field intensity, the reluctance between the first and second yoke plates 5*a* and 5*b* varies. At the same time, since the field intensity acting upon the flux rectifying cylinder 6 varies greatly the compensation effect of the flux rectifying cylinder 6 also varies greatly. In other words, even when the adjusting piece 7 is moved to an optimum position for adjusting the field intensity the temperature characteristic varies.

SUMMARY OF THE INVENTION

It is therefore an object of this invention to provide a magnetic field generator for use in an electromagnetic focusing type cathode ray tube that can efficiently prevent deterioration of the magnetic field intensity generated by a permanent magnet by disposing a flux rectifying member utilized to compensate for the temperature characteristic of the permanent magnet at a position not affected by a field adjusting mechanism.

According to this invention there is provided a magnetic field generator for use in an electromagnetic focusing type cathode ray tube of the type wherein the magnetic field generator is disposed on the outside of the cathode ray tube for focusing an electron beam in the tube and composed of a permanent magnet, a magnetic field adjusting mechanism for adjusting field intensity produced by the permanent magnet, and a magnetic member adapted to compensate for a temperature characteristic of the permanent magnet, characterized in that the temperature characteristic compensating member located at a position not affected by magnetic flux adjusted by the magnetic field adjusting mechanism.

DESCRIPTION OF THE PREFERRED EMBODIMENTS

Figure 1:
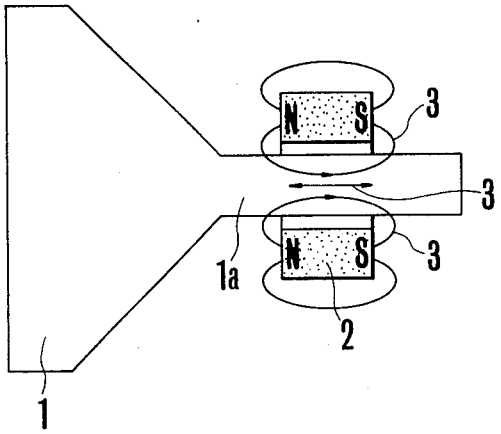
FIG.1 PRIOR ART
FIG. 1 is a diagrammatic representation of one example of a prior art electromagnetic focusing type cathode ray tube showing the basic construction thereof.
Figure 2:
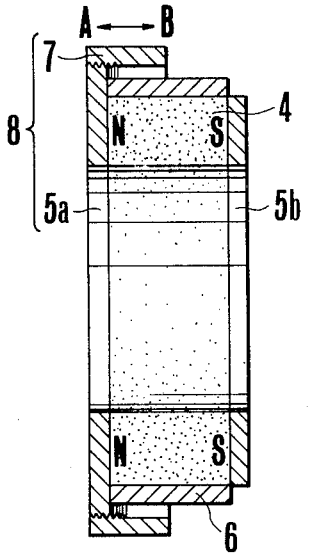
FIG.2 PRIOR ART
FIG. 2 is a sectional view showing one example of a prior art magnetic field generator.
Figure 3:
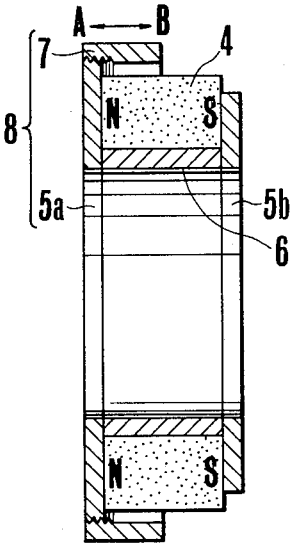
FIG. 3 is a sectional view showing one embodiment of the magnetic field generator according to this invention and utilized in an electromagnetic focusing type cathode ray tube.

A preferred embodiment of this invention will now be described with reference to FIG. 3 in which component parts corresponding to those shown in FIG. 2 are designated by the same reference numerals. In FIG. 3, a temperature compensating flux rectifying cylinder 6 made of Ni - Fe ferrite or thermal ferrite is disposed on the inner side of an annular permanent magnet 4 made of barium ferrite or strontium ferrite. More particularly, the temperature compensating flux rectifying cylinder 6 is bonded to the inner surface of the permanent magnet 4 so as not to be affected by the flux flowing through the field strength adjusting piece 7.

With this construction, even when the adjusting piece 7 is moved in the axial direction (A or B) of the tube by rotating the adjusting piece 7, the flux passing through the temperature compensating flux rectifying cylinder 6 would not be varied so that it is possible to provide a stable temperature compensation over the entire range of variation of the magnetic field effected by the field strength adjusting mechanism.

Figure 4:
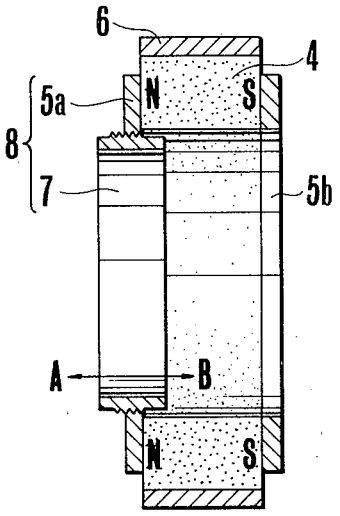
FIG. 4 is a sectional view showing a modified magnetic field generator embodying the invention.

FIG. 4 shows a modified embodiment of the magnetic field generator of this invention in which component elements corresponding to those shown in FIG. 2 are designated by the same reference numerals. In the embodiment shown in FIG. 4, on the inner periphery of the first yoke plate 5*a* is connected by screw threads a cylindrical adjusting piece 7 which finely adjusts the field intensity between the first and second yoke plates 5*a* and 5*b*. Thus the field intensity adjusting piece 7 is provided on the side of the permanent magnet 4 opposite to the temperature compensating flux rectifying cylinder 6, that is on the side not affecting the flux passing through the temperature compensating flux rectifying cylinder 6.

With this modification too, the movement of the field intensity adjusting piece 7 does not vary the flux flowing through the temperature compensating adjusting piece 7 so that it is possible to obtain a stable temperature compensation over the entire range of flux variation of the field intensity adjusting mechanism.

Figure 5:
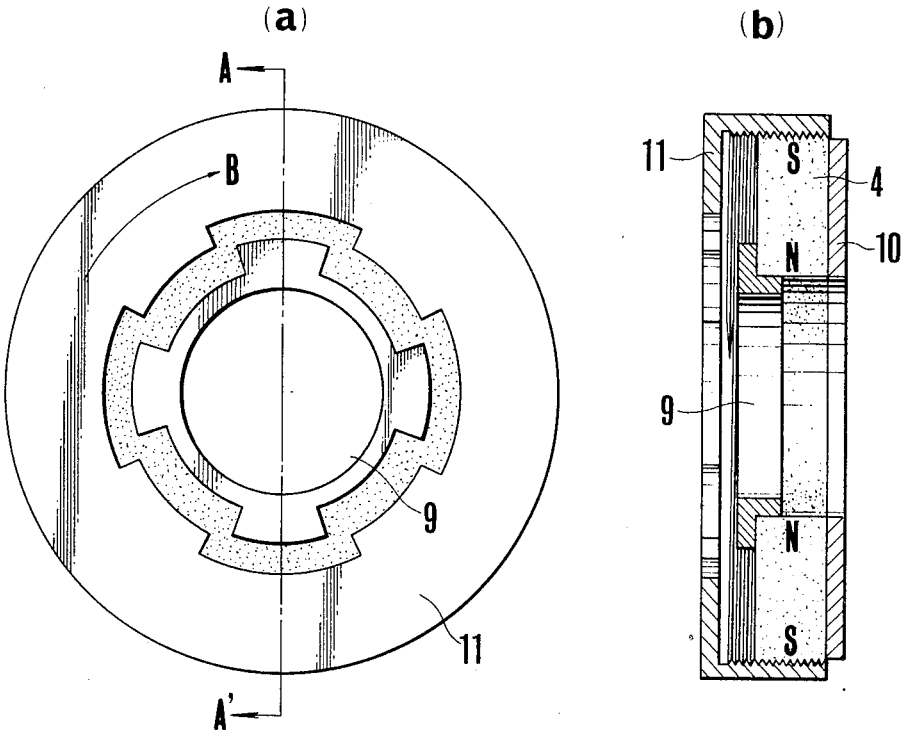
FIG. 5*a* is a front view of another modification of the magnetic field generator embodying the invention.
FIG. 5*b* is a sectional view of the modification shown in FIG. 5*a;*.

FIGS. 5*a* and 5*b* show still another embodiment of this invention in which elements corresponding to those shown in FIGS. 2 and 4 are designated by the same reference numerals. In FIGS. 5*a* and 5*b*, the annular permanent magnet 4 is magnetized in a direction perpendicular to the tube axis. An annular yoke 9 made of soft ferromagnetic material is secured to the inner surface of the N pole of the annular permanent magnet 4 for rectifying the magnetic field, and a magnetic flux rectifying plate 10 made of temperature compensating material is secured to one surface of the permanent magnet 4. A cup shaped field intensity adjusting piece 11 made of soft ferromagnetic material is threaded on the outer surface that is the S pole of the permanent magnet 4.

The field intensity can be adjusted by moving the field intensity adjusting piece 11 in the axial direction of the tube. In this embodiment too, since the temperature compensating adjusting plate 10 is located at a position not affected by the flux flowing through the field intensity adjusting piece 11 of the permanent magnet 4, it is possible to stably compensate for the temperature over a wide range of variation of the magnetic field.

Figure 6:
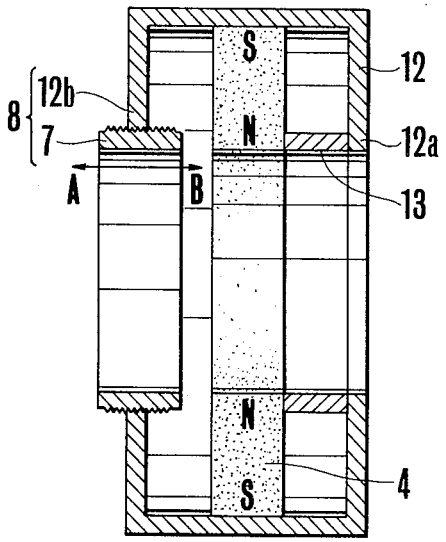
FIG. 6 is a sectional view showing still another modification of the magnetic field generator embodying the invention.

FIG. 6 shows still further modification of the magnetic field generator of this invention which comprises a hollow annular yoke 12 made of soft ferromagnetic material with its inner surface engaged with the outer surface or S pole of the permanent magnet 4 magnetized in the same direction as the permanent magnet shown in FIG. 5*b* for rectifying the magnetic field produced by the permanent magnet 4 and a flux rectifying ring 13 disposed between the inner opening 12*a* of the yoke 12 and one side surface of the N pole of the permanent magnet 4, the ring 13 being made of a magnetic material whose permeability varies with temperature thereby compensating for the temperature characteristic of the permanent magnet 4. A cylindrical adjusting piece 7 is threaded in the opposite or inner opening 12*b* of the yoke 12 for finely adjusting the field strength, the opening 12*b* and the adjusting piece 7 constituting a field strength adjusting mechanism 8.

In this modification too, since the field strength adjusting mechanism 8 and the flux rectifying cylinder 13 are disposed on the opposite sides of the permanent magnet 4, movement of the adjusting piece 7 does not vary the flux passing through the temperature compensating flux rectifying cylinder 13 so that it is possible to stably compensate for the temperature characteristic over the entire range of the field variation provided by the field intensity adjusting mechanism 8.

As above described, according to this invention, since the temperature compensating flux rectifying member for the permanent magnet is disposed at a position not affected by the field intensity adjusting mechanism it is possible to prevent decrease in the magnetic field produced by the permanent magnet caused by temperature rise. Consequently, it is possible to prevent degradation in the resolution of the picture image caused by temperature variation. Moreover, it is possible to produce a picture image of a high resolution by using a cheap soft ferromagnetic material instead of an expensive permanent magnet.

What is claimed is:

1. In a magnetic field generator for use in an electromagnetic focusing type cathode ray tube of the type wherein the magnetic field generator is disposed on the outside of said cathode ray tube for focusing an electron beam in the tube and composed of a permanent magnet, a magnetic field adjusting mechanism for adjusting field intensity produced by said permanent magnet, and a magnetic member adapted to compensate for a temperature characteristic of said permanent magnet the improvement wherein said temperature characteristic compensating member is located at a position not affected by magnetic flux adjusted by said magnetic field adjusting mechanism.

2. The magnetic field generator according to claim 1 wherein said permanent magnet comprises an annular permanent magnet magnetized in an axial direction of said cathode ray tube, said magnetic field adjusting mechanism is provided on an outer periphery of said permanent magnet, and said temperature characteristic compensating magnetic member is provided on an inner periphery of said permanent magnet.

3. The magnetic field generator according to claim 2 wherein said magnetic field adjusting mechanism comprises a magnetic yoke plate on one side surface of said annular permanent magnet and a magnetic adjusting piece threaded on an outer periphery of said magnetic yoke plate.

4. The magnetic field generator according to claim 2 wherein said magnetic field adjusting mechanism comprises a magnetic yoke plate on one side surface of said annular permanent magnet and a magnetic adjusting piece threaded on an inner periphery of said magnetic yoke plate.

5. The magnetic field generator according to claim 1 wherein said permanent magnet comprises an annular permanent magnet magnetized in a direction perpendicular to an axis of said cathode ray tube and said magnetic field adjusting mechanism comprises a cup shaped ferromagnetic member threaded on an outer periphery of said permanent magnet.

6. The magnetic field generator according to claim 1 wherein said permanent magnet comprises an annular permanent magnet magnetized in a direction perpendicular to an axis of said magnetic field adjusting mechanism comprises a hollow annular magnetic yoke surrounding said annular permanent magnet and a magnetic cylindrical adjusting member threaded to an inner periphery of said magnetic yoke.

* * * * *